US006415989B1

(12) United States Patent
Lasserre et al.

(10) Patent No.: US 6,415,989 B1
(45) Date of Patent: Jul. 9, 2002

(54) DISPENSING HEAD FOR VARYING SIZES OF DISPENSING MEMBERS

(75) Inventors: Pierre-André Lasserre, Coubron; Gilles Baudin, Domont, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/547,072

(22) Filed: Apr. 11, 2000

(30) Foreign Application Priority Data

Apr. 12, 1999 (FR) ..... 99 04532

(51) Int. Cl.[7] ..... B05B 17/00; B05B 9/043

(52) U.S. Cl. ..... 239/1; 239/333; 239/337; 239/463; 239/602

(58) Field of Search ..... 239/1, 546, 333, 239/337, 602, 588, 463, 464, 533.1, 533.13, DIG. 12; 222/490, 491, 494, 495, 402.1, 402.13; 251/150; 285/345, 423; 403/372, 367, 365; 215/317, 321; 220/784

(56) References Cited

U.S. PATENT DOCUMENTS 2,731,298 A * 1/1956 Green ..... 239/333
3,008,654 A 11/1961 Abplanalp et al.
3,083,917 A 4/1963 Abplanalp et al.
3,083,918 A 4/1963 Abplanalp et al.
5,622,318 A * 4/1997 Bougamont et al. ..... 239/333
5,735,465 A 4/1998 De Laforcade

FOREIGN PATENT DOCUMENTS

| | | |
|---|---|---|
| BE | 560115 | 9/1957 |
| DE | 196 10 184 | 9/1997 |
| EP | 0 734 969 | 10/1996 |
| FR | 1 512 794 | 2/1968 |

OTHER PUBLICATIONS

English language Derwent Abstract of DE 196 10 184.

* cited by examiner

*Primary Examiner*—Steven J. Ganey
(74) *Attorney, Agent, or Firm*—Finnegan, Henderson, Farabow, Garrett & Dunner, LLP

(57) ABSTRACT

A dispensing head configured to actuate a dispensing member, particularly a pump or valve, and for dispensing a product, particularly a cosmetic product, via at least one dispensing outlet formed in the dispensing head. The dispensing head includes an element capable of forming a seal between the dispensing head and an inside surface of a pump or valve stem of the dispensing member. The sealing element is configured to engage in a sealed manner inside the pump or valve stem and to make a seal on pump or valve stems of differing inside surface dimensions.

80 Claims, 2 Drawing Sheets

DISPENSING HEAD FOR VARYING SIZES OF DISPENSING MEMBERS

The present invention relates to a dispensing head for actuating a dispensing mechanism, such as, for example, a valve or a pump, to dispense a product contained in a container via at least one dispensing orifice. For example, the dispensing head may be used to dispense a cosmetic product contained in a container. The dispensing head of the present invention is particularly suited for use with pressurized containers, for example containers pressurized by means of a propellent gas that may be separated from the product by a piston. For example, these types of containers are used to package and dispense hair products, such as a spray, a lacquer, a mousse, a gel or a cream, or bodycare products.

A conventional dispensing head having a relatively simple structure is in the form of a push-button. Such push-button dispensing heads may be made of materials such as polyethylene or polypropylene. These dispensing heads include a connecting sleeve that is push-fitted onto the exterior surface of a pump or valve stem, which generally is in the form of a hollow tubular element. This push-fit serves to seal the connection between the dispensing head and the pump or valve stem. The push-button forms a surface that can be pressed, allowing the pump or valve to be actuated.

A more sophisticated type of dispensing head includes a band mounted fixedly on a container, and having a part that can move with respect to the band to connecting element communicating with a dispensing orifice of the head is push-fitted onto the valve or pump stem, thus sealing the connection between the dispensing head and the pump or valve stem.

Not all of the valves made by manufacturers have valve stems of the same outside diameter. Thus, valves made by different manufacturers may have diameters that vary on the order of 0.5 mm or more. Thus, a dispensing head may be suitable for a valve made by one manufacturer but ill-suited for a valve made by another manufacturer. This is because the connection of any given dispensing head to a valve when accomplished by a push-fit, and therefore a sealed fit, on a valve of one inner diameter will not be a push-fit onto a different type of valve using a valve stem of a different inner diameter. In general, the same is true of pumps.

Thus, each type of pump or valve entails the manufacture of a dispensing head using a mold specific to the size of the pump or valve stem. This substantially increases the cost of manufacture. Moreover, push-fit connections sometimes pose problems with regard to the manufacturing tolerances on the various parts that have to be assembled.

BE-A-560,115 describes a valve stem on which a push-button is mounted. A push-button connecting element is configured to be inserted inside the valve stem. The connecting element is of constant exterior cross section. Consequently, assuming that this connecting element is intended to make a seal, it can be fitted in a sealed manner only on valve stems having substantially identical inside diameters.

In EP-A-0,734,969, an element is configured to be inserted inside the valve stem. The element has a constant exterior cross section. The interior cross section of the sealing element varies in the axial direction. However, this variation has no effect on the stem diameters on which the element can be fitted in a sealed manner. Thus, as was the case with BE-A-560,115, assuming that it is intended to make a seal, an element of this kind can form a seal only on valve stems having substantially identical insider diameters.

One of the objects of the present invention is to provide a "universal" dispensing head which solves all or some of the problems discussed hereinabove with reference to the conventional dispensing heads.

Another object of the invention is to provide a dispensing head which can be mounted on pump or valve stems having differing diameters.

It should be understood that the invention could be practiced without performing one or more of the preferred objects and/or advantages described above. Other objects of the invention will become apparent from the detailed description which follows.

To achieve these and other advantages, and in accordance with the purposes of the invention, as embodied and broadly described herein, the invention includes a dispensing head configured for actuating one of a pump and a valve, to dispense a product, such as, for example, a cosmetic product, via at least one dispensing outlet. The dispensing head includes a sealing element configured to sealingly engage with an inside surface of a stem of the dispensing member. The sealing element is configured to engage in a sealed manner with dispensing member stems of differing inside surface dimensions, especially differing inside surface diameters.

Thus, according to the invention sealing is achieved inside the pump or valve stem on which the dispensing head is mounted, making it possible by using a sealing element of appropriate shape to make a seal, regardless of the inner diameter of the pump or valve stem, at least within a given range. By way of example, the extent of such a range may be on the order of about one millimeter or more. In other words, a single dispensing head according to the invention could be used with stems having inner diameters differing by at least about one millimeter or more, for example. This then avoids the problem associated with the differences in diameter of pump or valve stems that are encountered between different manufacturers. It is thus possible to produce dispensing heads which can be fitted onto pump or valve stems which do not have the same diameter, and thus the same dispensing head may be used for different types of valves or pumps made by different manufacturers.

Preferably, the sealing element is formed by a skirt having an axially variable exterior cross section. As a preference, the exterior cross section of the sealing, element decreases gradually in a direction toward the dispensing member. Also as a preference, the sealing skirt forms a conical frustum whose vertex faces toward the dispensing member. Thus, the connecting element can be pushed into the pump or valve stem to a greater or lesser depth, depending on the inner diameter of the valve or pump stem, in order to sealingly engage with the stem.

According to another preferred aspect of the invention, unlike conventional devices, the dispensing head is attached to the dispensing member by a mechanism that is separate from that which provides the seal between the dispensing head and the pump or valve stem of the dispensing member. Thus, in a preferred embodiment, the dispensing head comprises a connecting element configured to attach the dispensing head to the pump or valve stem of the dispensing member. The connecting element includes an elastically deformable means capable of pressing elastically against an exterior surface of the pump or valve stem. Thus, in the case of a push-button, the push-button is held on the pump or valve stem by the elastic grip of the connecting element on the pump or valve stem. However, this grip preferably does not make the sealed connection between the pump or valve stem and the dispensing head. Rather, the sealed connection is achieved by an auxiliary element engaging the inside of the pump or valve stem.

According to a preferred embodiment, the elastically deformable means includes a plurality of fins arranged on an interior surface of the connecting element. At least the free end of each fin is intended to engage elastically against an exterior surface of the pump or valve stem.

When mounted on the pump or valve stem, the fins may be orientated at a mean angle, at least at their free end, this angle ranging from 10° to 80° with respect to a radial direction to the connecting element.

Preferably, near a free end of the connecting element, the fins have a profile, for example a chamfered profile, which is able to assist with mounting the connecting element on the pump or valve stem. The free end of the pump or valve stem may also have a profile, for example a rounded or chamfered profile, able to encourage the fins to engage on the external surface of the pump or valve stem.

The at least one dispensing orifice may be formed in a diffuser member such as a nozzle, for example one which induces swirl, a grating, an open-cell or semi-open-cell foam or a sintered element, such as, for example, a ceramic or thermoplastic sintered element.

Another aspect of the invention includes an assembly for storing and dispensing a product, particularly a cosmetic product, The assembly includes a container containing the product. The assembly is fit with a dispensing member, particularly with a pump or a valve, and with a dispensing head according to the invention attached to the dispensing member. The dispensing head preferably is configured to dispense the product under pressure via at least one dispensing orifice or outlet.

The assembly may further include a pressurized assembly containing a product, particularly a cosmetic product, pressurized by means of a propellent gas or a piston, and surmounted by a valve. The valve may be of the type that has to be depressed or of the type that has to be pivoted.

A further aspect of the invention includes a dispensing head for actuating a dispensing member to dispense a product. The dispensing head comprises a body portion defining an outlet through which the product to be dispensed exits. The dispensing head further comprises a connecting member configured to provide flow communication between the outlet and a hollow interior defined by an inside surface of the dispensing member. The connecting member is configured to sealingly engage at least a portion of the inside surface of each of a plurality of dispensing members having differing inside surface dimensions. In a preferred embodiment, the connecting member is configured to sealingly engage dispensing members having substantially differing inside surface diameters.

In another aspect of the invention, the dispensing head forms a portion of a dispensing assembly having a container for containing the product to be dispensed, and a dispensing member on the container.

Yet another aspect of the invention includes a process for producing a dispensing assembly. The process includes providing the dispensing head and providing at least one container containing the product, the container including a dispensing member having one of a plurality of differing inside surface dimensions. The sealing element of the dispensing head is inserted into the dispensing member until the sealing element engages with the inside surface of the dispensing member. The dispensing head may then actuated to thereby actuate the dispensing member to dispense the product through the outlet.

Besides the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a cross-sectional view of dispensing head according to an embodiment of the present invention fitted to a dispensing assembly having a valve type dispensing member;

Figure 1:
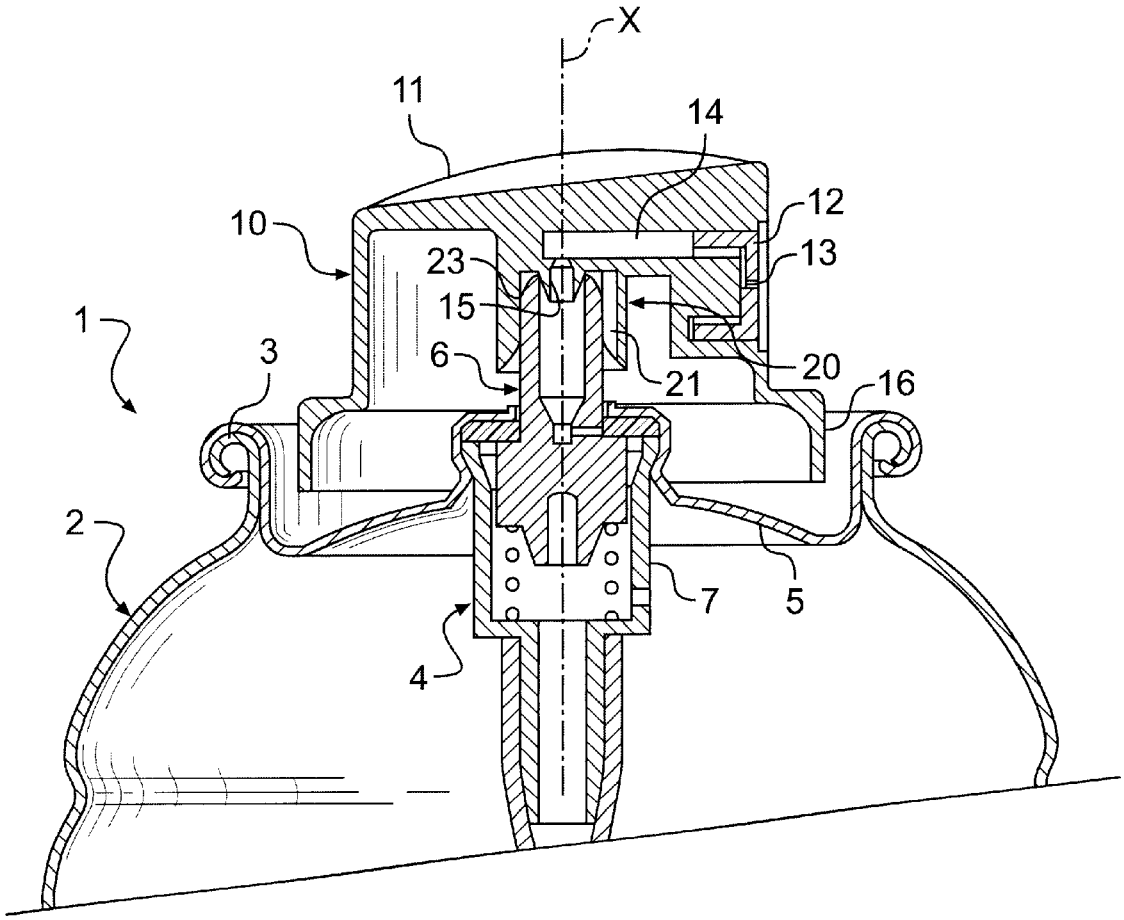

The packaging and dispensing assembly 1 shown in FIG. 1 includes a container 2 that may be in the form of a can, made, for example, of tin or aluminum. The container 2 has a free edge delimiting an opening 3 in which a pump or valve 4 is mounted. The valve 4 is crimped onto a valve-holder dish 5, which is disposed in the opening 3. The valve is a conventional valve known to those skilled in the art. In the embodiment of FIG. 1, the valve 4 is of the type which is actuated by depressing it. The valve 4 includes a valve stem 6 in the form of a hollow tubular element emerging from a valve body 7. The valve stem 6 may have an outside diameter ranging from, for example, about 3.3 mm to about 4 mm depending on the valve manufacturer. The inner diameter of the valve stem 6 also varies according to the manufacturer. It may range from about 2 mm to about 2.5 mm, for example.

Mounted in a sealed manner on the valve stem 6 is a dispensing head 10 in the form of a push-button having a longitudinal axis X coincident with the axis of the container 2 and with the axis of the valve 4. The dispensing head 10 has a surface 11 configured to be pressed. Upon pressing down on surface 11, the valve 4 is actuated. At the same time, a swirl-inducing nozzle 12, pierced at its centre with a dispensing orifice 13, also is actuated. The swirl-inducing nozzle is fed by a duct 14 that is perpendicular to the axis X and opens at the axis X inside a sealing skirt 15 configured, as will be explained in greater detail with reference to the discussion of FIG. 2, to allow the dispensing head 10 to be mounted in a sealed manner on the valve stem 6. The push-button has a lateral skirt 16 having a free end placed some distance from the closed end of the dish 5 so that it can be depressed in response to a pressing force exerted on the surface 11. The dispensing head 10 preferably is made of polypropylene or polyethylene, or other suitable like materials.

As is evident in detail by reference to FIGS. 2 and 3A–3C, a connecting element 20 mounts the dispensing head 10 on the valve stem 6. The connecting element 20 is preferably in the form of a skirt concentric with the sealing skirt 15. The interior surface of the connecting element 20 includes uniformly spaced fins 21. At least the free end of each of the fins 21 points in a direction other than a radial direction. The mean angle formed by the free end 22 of the fins 21 with respect to a the radial direction of the sleeve 20 preferably is on the order of about 50° to about 60°. The free end 22 of each fin 21 is intended to press elastically against a corresponding portion of the outer surface 23 of the valve stem 6.

Figure 2:
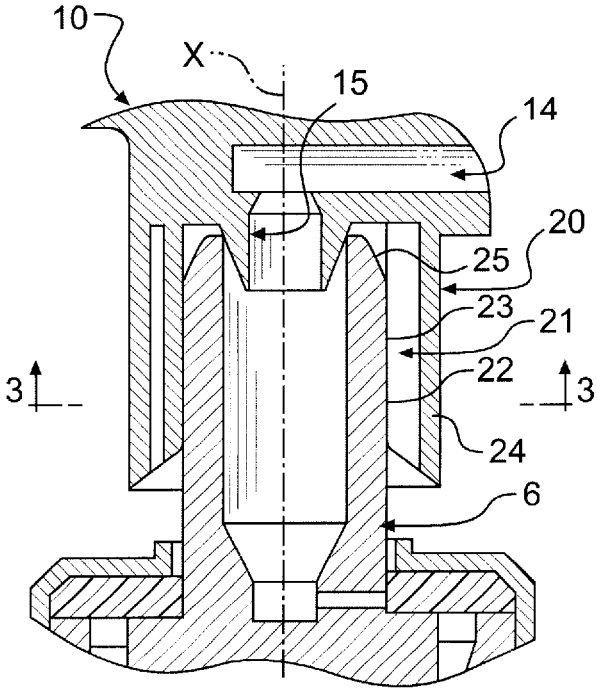
FIG. 2 is a detailed cross-sectional view showing the mounting of the connecting element of the dispensing head on the valve stem of the dispensing assembly of FIG. 1.

In the mounted position illustrated in FIG. 2, the sealing skirt 15 engages inside the valve stem 6. Because of the frusto-conical profile of the exterior surface of the sealing skirt 15, depending on the inner diameter of the valve stem 6, the skirt engages inside the valve stem 6 to a greater or lesser depth. Thus, a sealed connection to differing valves is produced, regardless of the inside diameter of the valve stems, within a given range of variation. Similarly, in the mounted position, the fins 21 have their free ends 22 pressed elastically against the exterior surface 23 of the valve stem, thus holding the dispensing head 10 in position on the valve stem 6. Because of the elasticity of the fins 21, the dispensing head 10 is held in position on the valve 4 regardless of the outside diameter of the valve stem 6, within a given range of variation. The dispensing head 10 according to this embodiment of the invention can thus accommodate outside diameters varying by about 1 mm or more of the valve stem 6.

Figure 3A:
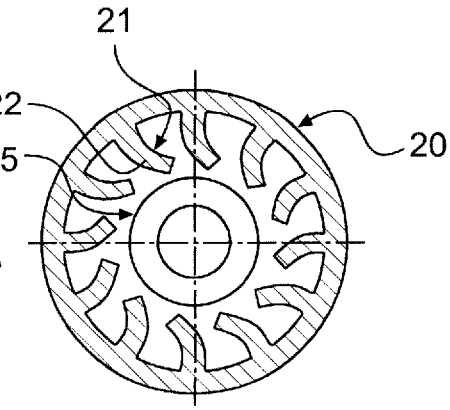
FIG. 3A is a cross-sectional view taken along line 3—3 of FIG. 2 showing the connecting element prior to mounting on the valve stem.
Figure 3B:
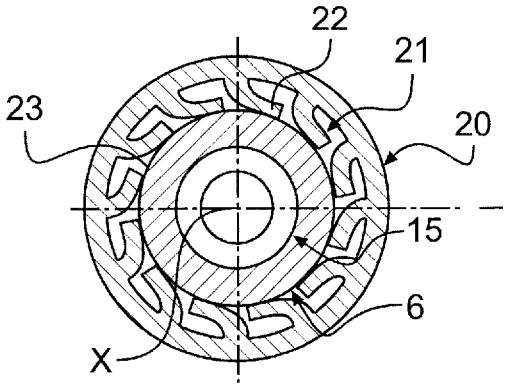
FIG. 3B is a cross-sectional view similar to FIG. 3A showing the connecting element mounted on a valve stem having a larger outside diameter as compared with the valve stem shown in FIG. 3C.
Figure 3C:
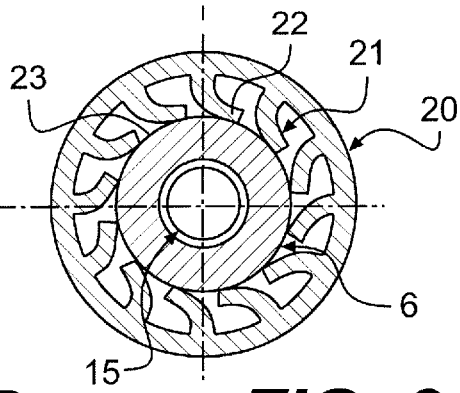
FIG. 3C is a cross-sectional view similar to FIG. 3B showing the connecting element mounted on a valve stem having a smaller outside diameter as compared with the valve stem shown in FIG. 3B.

In the cross-sectional view of FIG. 3A, the connecting element 20 is not mounted on a dispensing member, such as a valve, and therefore the fins 21 are not elastically stressed. In FIG. 3B, the dispensing head 10 is mounted on a valve stem 6. The fins are elastically stressed so that they grip on the valve stem 6. In FIG. 3C, the dispensing head 10 is mounted on a valve stem 6 with an outside diameter that is smaller than the outside diameter of the valve stem 6 of FIG. 3B. The mean angle formed by the free end of the fins 21 with respect to the radial direction to the sleeve 20 is smaller in FIG. 3C than in FIG. 3B. In both instances, the grip exerted by the fins 21 on the exterior surface 23 of the valve stem 6 is strong enough to hold the dispensing head 10 in place on the valve stem 6.

According to another aspect of the invention, near the free end 24 of the connecting element 20, the fins 21 have a chamfered or beveled profile so that, in cooperation with a rounded profile of the free end 25 of the valve stem 6, they assist with mounting the dispensing head 10 on the valve stem 6.

Preferably, the container 2 of the dispensing assembly 1 contains a cosmetic, pharmaceutical, or dermo-pharmaceutical product. However, in its broadest aspects, the present invention could be used to store and dispense many other types of flowable substances. Furthermore, sizes of various structural parts and materials used to make these parts are illustrative and exemplary only and one of ordinary skill in the art would recognize that these materials and sizes can be changed as necessary to product different effects or desired characteristics of the dispensing assembly.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A dispensing head for dispensing a product by actuating one of a pump and a valve, comprising:

at least one dispensing outlet through which the product is dispensed; and a sealing element configured to sealingly engage an inside surface of a stem formed on one of the pump and the valve, the sealing element being further configured to sealingly engage stems of differing inside transverse surface dimensions.

2. The dispensing head of claim 1, further comprising a connecting element configured to attach the dispensing head to the stem of one of the pump and the valve.

3. The dispensing head of claim 2, wherein the connecting element includes at least one elastically deformable member configured to elastically press against an outside surface of the stem of one of the pump and the valve.

4. The dispensing head of claim 3, wherein the elastically deformable member is in the form of a fin disposed on an interior surface of the connecting element and having at least a free end configured to engage elastically with the outside surface of the stem of one of the pump and the valve.

5. The dispensing head of claim 4, wherein a plurality of elastically deformable members are disposed on the interior surface of the connecting element around a longitudinal axis of the connecting element.

6. The dispensing head of claim 4, wherein the free end of the fin has a beveled profile.

7. The dispensing head of claim 1, Wherein the outlet is an orifice formed in a diffuser member.

8. The dispensing head of claim 7, wherein the diffuser member is chosen from a nozzle, a grating, an open-cell foam, a semi-open cell foam, and a sintered element.

9. The dispensing head of claim 8, wherein the diffuser member is configured to cause the product to swirl during dispensing.

10. An assembly for storing and dispensing a product, comprising:

a container configured to contain the product to be dispensed;

a dispensing member in the form of one of a pump and a valve on the container; and the dispensing head of claim 1 attached to the dispensing member.

11. The assembly of claim 10, wherein the container is pressurized and the dispensing member is a valve.

12. The assembly of claim 10, wherein the container contains a cosmetic product.

13. A process for producing a dispensing assembly, comprising:

providing the dispensing head according to claim 1;

providing at least one container containing a product, the container including a dispensing member having one of a plurality of differing inside surface dimensions; and inserting the sealing element of the dispensing head into the dispensing member until the sealing element engages with a portion of the inside surface of the dispensing member.

14. The process of claim 13, further comprising pressing a push-button mechanism on the dispensing head to dispense the product.

15. The process of claim 13, further comprising attaching a connecting element to the dispensing member by engaging at least one elastically deformable member with an exterior surface portion of the dispensing member.

16. The process of claim 13, further comprising actuating the dispensing head to thereby cause dispensing of the product through the outlet.

17. The dispensing head of claim 1, wherein the sealing element includes a skirt with an axially variable exterior cross-section.

18. The dispensing head of claim 17, wherein the skirt has a frustoconical shape.

19. The dispensing head of claim 18, wherein the skirt has a vertex that faces the stem when the dispensing head is engaged with the stem.

20. The process of claim 13, wherein the providing the container includes providing a container containing a cosmetic product.

21. A dispensing head for dispensing a product by actuating one of a pump and a valve, comprising:

at least one dispensing outlet through which the product is dispensed; and a sealing element configured to sealingly engage an inside surface of a stem formed on one of the pump and the valve, the sealing element being further configured to sealingly engage stems having substantially differing inside surface diameters.

22. The dispensing head of claim 21, wherein the sealing element includes a skirt with an axially variable exterior cross-section.

23. The dispensing head of claim 22, wherein the skirt has a frustoconical shape.

24. The dispensing head of claim 23, wherein the skirt has a vertex that faces the stem when the dispensing head is engaged with the stem.

25. The dispensing head of claim 21, further comprising a connecting element configured to attach the dispensing head to the stem of one of the pump and the valve.

26. The dispensing head of claim 25, wherein the connecting element includes at least one elastically deformable member configured to elastically press against an outside surface of the stem of one of the pump and the valve.

27. The dispensing head of claim 26, wherein the elastically deformable member is in the form of a fin disposed on an interior surface of the connecting element and having at least a free end configured to engage elastically with the outside surface of the stem of one of the pump and the valve.

28. The dispensing head of claim 27, wherein a plurality of elastically deformable members are disposed on the interior surface of the connecting member around a longitudinal axis of the connecting member.

29. The dispensing head of claim 27, wherein the free end of the fin has a beveled profile.

30. The dispensing head of claim 21, wherein the outlet is an orifice formed in a diffuser member.

31. The dispensing head of claim 30, wherein the diffuser member is chosen from a nozzle, a grating, an open-cell foam, a semi-open-cell foam, and a sintered element.

32. The dispensing head of claim 31, wherein the diffuser member is configured to cause the product to swirl during dispensing.

33. An assembly for storing and dispensing a product, comprising:

a container configured to contain the product to be dispensed;

a dispensing member in the form of one of a pump and a valve on the container; and the dispensing head of claim 21 attached to the dispensing member.

34. The assembly of claim 33, wherein the container is pressurized and the dispensing member is a valve.

35. The assembly of claim 33, wherein the container contains a cosmetic product.

36. A dispensing head for dispensing a product by actuating one of a pump and a valve, comprising:

at least one dispensing outlet through which the product is dispensed; and a sealing element including a skirt with an axially variable exterior cross-section and being configured to sealingly engage an inside surface of a stem formed on one of the pump and the valve, the sealing element being further configured to sealingly engage stems of differing inside surface dimensions.

37. The dispensing head of claim 36, wherein the skirt has a frustoconical shape.

38. The dispensing head of claim 37, wherein the skirt has a vertex that faces the stem when the dispensing head is engaged with the stem.

39. An assembly for storing and dispensing a product, comprising:

a container containing a cosmetic product to be dispensed;

a dispensing member in the form of one of a pump and a valve on the container;

a dispensing head for dispensing the product by actuating one of the pump and the valve, the dispensing head attached to the dispensing member and comprising at least one dispensing outlet through which the product is dispensed, and a sealing element configured to sealingly engage an inside surface of a stem formed on one of the pump and the valve, the sealing element being further configured to sealingly engage stems of differing inside surface dimensions.

40. A dispensing head for actuating a dispensing member to dispense a product, comprising:

a body portion defining an outlet through which the product being dispensed exits; and a connecting member being configured to provide flow communication between the outlet and a hollow interior defined by an inside surface of the dispensing member to be actuated, the connecting member being configured to sealingly engage at least a portion of the inside surface of each of a plurality of dispensing members having differing inside transverse surface dimensions.

41. The dispensing head of claim 40, further comprising a push-button mechanism, the push-button mechanism being configured to be depressed and to thereby actuate the dispensing member.

42. The dispensing head of claim 40, wherein the dispensing member to be actuated is chosen from a pump and a valve.

43. The dispensing head of claim 40, wherein the inside surface is on a stem of the dispensing member.

44. The dispensing head of claim 40, wherein the connecting member is further configured to engage an exterior surface portion of the dispensing member.

45. The dispensing head of claim 44, wherein the connecting member includes at least one elastically deformable member configured to engage the exterior surface portion of the dispensing member.

46. The dispensing head of claim 45, wherein the elastically deformable member is configured to deform to differing degrees with respect to a radial axis of the connecting member.

47. The dispensing head of claim 45, wherein the elastically deformable member includes a fin.

48. The dispensing head of claim 45, wherein the elastically deformable member presses elastically on the exterior surface portion of the dispensing member to thereby attach the dispensing head to the dispensing member.

49. The dispensing head of claim 40, wherein the outlet is an orifice formed in a diffuser member.

50. The dispensing head of claim 49, wherein the diffuser member is chosen from a nozzle, a grating, an open-cell foam, a semi-open-cell foam, and a sintered element.

51. A dispensing assembly for dispensing a product, comprising:

a container for holding the product to be dispensed;

a dispensing member on the container; and the dispensing head of claim 40.

52. The dispensing assembly of claim 51, wherein the container contains a cosmetic product to be dispensed.

53. The dispensing head of claim 40, wherein the connecting member includes a frustoconical sealing element, said sealing element providing the sealing engagement with the inside surface portion of the dispensing member.

54. The dispensing head of claim 53, wherein a vertex of the frustoconical sealing element forms a free end of the sealing element, the free end being configured to be inserted into the hollow interior of the dispensing member.

55. The dispensing head of claim 53, wherein an exterior surface portion of the sealing element sealingly engages with the inside surface portion of the dispensing member.

56. A dispensing head for actuating a dispensing member to dispense a product, comprising:

a body portion defining an outlet through which the product being dispensed exits; and a connecting member being configured to provide flow communication between the outlet and a hollow interior defined by an inside surface of the dispensing member to be actuated, the connecting member being configured to sealingly engage at least a portion of the inside surface of each of a plurality of dispensing members having substantially differing inside surface diameters.

57. The dispensing head of claim 56, further comprising a push-button mechanism, the push-button mechanism being configured to be depressed and to thereby actuate the dispensing member.

58. The dispensing head of claim 56, wherein the dispensing member to be actuated is chosen from a pump and a valve.

59. The dispensing head of claim 56, wherein the inside surface is on a stem of the dispensing member.

60. The dispensing head of claim 56, wherein the connecting member includes a frustoconical sealing element, said sealing element providing the sealing engagement with the inside surface portion of the dispensing member.

61. The dispensing head of claim 60, wherein a vertex of the frustoconical sealing element forms a free end of the sealing element, the free end being configured to be inserted into the hollow interior of the dispensing member.

62. The dispensing head of claim 60, wherein an exterior surface portion of the sealing element sealingly engages with the inside surface portion of the dispensing member.

63. The dispensing head of claim 56, wherein the connecting member is further configured to engage an exterior surface portion of the dispensing member.

64. The dispensing head of claim 63, wherein the connecting member includes at least one elastically deformable member configured to engage the exterior surface portion of the dispensing member.

65. The dispensing head of claim 64, wherein the elastically deformable member is configured to deform to differing degrees with respect to a radial axis of the connecting member.

66. The dispensing head of claim 64, wherein the elastically deformable member includes a fin.

67. The dispensing head of claim 64, wherein the elastically deformable member presses elastically on the exterior surface portion of the dispensing member to thereby attach the dispensing head to the dispensing member.

68. The dispensing head of claim 56, wherein the outlet is an orifice formed in a diffuser member.

69. The dispensing head of claim 68, wherein the diffuser member is chosen from a nozzle, a grating, an open-cell foam, a semi-open-cell foam, and a sintered element.

70. A dispensing assembly for dispensing a product, comprising:

a container for holding the product to be dispensed;

a dispensing member on the container; and the dispensing head of claim 56.

71. The dispensing assembly of claim 70, wherein the container contains a cosmetic product to be dispensed.

72. A dispensing head for actuating a dispensing member to dispense a product, comprising:

a body portion defining an outlet through which the product being dispensed exits; and a connecting member being configured to provide flow communication between the outlet and a hollow interior defined by an inside surface of the dispensing member to be actuated, the connecting member being configured to sealingly engage at least a portion of the inside surface of each of a plurality of dispensing members having differing inside surface dimensions, wherein the connecting member includes a frustoconcial sealing element providing sealing engagement with the inside surface portion of the dispensing member.

73. The dispensing head of claim 72, wherein a vertex of the frustoconical sealing element forms a free end of the sealing element, the free end being configured to be inserted into the hollow interior of the dispensing member.

74. The dispensing head of claim 72, wherein an exterior surface portion of the sealing element sealingly engages with the inside surface portion of the dispensing member.

75. A dispensing assembly for dispensing a product, comprising:

a container containing a cosmetic product to be dispensed;

a dispensing member on the container; and a dispensing head for actuating the dispensing member to dispense the cosmetic product, the dispensing head comprising a body portion defining an outlet through which the product being dispensed exits, and a connecting member being configured to provide flow communication between the outlet and a hollow interior defined by an inside surface of the dispensing member to be actuated, the connecting member being configured to sealingly engage at least a portion of the inside surface of each of a plurality of dispensing members having differing inside surface dimensions.

76. A process for producing a dispensing assembly, comprising:

providing a dispensing head for dispensing a product by actuating one of a pump and a valve, the dispensing head comprising at least one dispensing outlet through which the product is dispensed, and a sealing element configured to sealingly engage an inside surface of a stem formed on one of the pump and the valve, the sealing element being further configured to sealingly engage stems of differing inside surface dimensions; and providing at least one container containing a cosmetic product, the container including a dispensing member having a stem having one of a plurality of differing inside surface dimensions; and inserting the sealing element of the dispensing head into the stem of the dispensing member until the sealing element engages with a portion of the inside surface of the stem.

77. A process for producing a dispensing assembly, comprising:

providing a dispensing head comprising at least one dispensing outlet through which a product is dispensed and a sealing element configured to sealingly engage an inside surface of a stem formed on one of a pump and a valve, the sealing element being further configured to sealingly engage stems of differing inside surface dimensions;

providing at least one container containing a product, the container including a dispensing member having one of a plurality of differing inside surface dimensions;

inserting the sealing element of the dispensing head into the dispensing member until the sealing element engages with a portion of the inside surface of the dispensing member; and removing the dispensing head from the container, providing a second container having a second dispensing member having an inside surface dimension which differs from that of the first dispensing member, and inserting the sealing element of the dispensing head into the second dispensing member until the sealing element engages with an inside surface portion of the second dispensing member.

78. A dispensing head for actuating a dispensing member to dispense a product, comprising:

a body portion defining an outlet through which the product being dispensed exits; and a connecting member being configured to provide flow communication between the outlet and a hollow interior defined by an inside surface of the dispensing member to be actuated, the connecting member being configured to sealingly engage at least a portion of the inside surface of each of a plurality of dispensing members having differing inside surface dimensions, wherein the connecting member includes a sealing element providing sealing engagement with the inside surface of the dispensing member, the sealing element having a skirt with an axially variable exterior cross-section.

79. The dispensing head of claim 78, wherein the skirt has a frustoconical shape.

80. The dispensing head of claim 79, wherein the skirt has a vertex that faces the dispensing member when the dispensing head is engaged with the dispensing member.

* * * * *

UNITED STATES PATENT AND TRADEMARK OFFICE

CERTIFICATE OF CORRECTION

PATENT NO. : 6,415,989 B1 
DATED : July 9, 2002
INVENTOR(S) : Pierre-André Lasserre et al.

It is certified that error appears in the above-identified patent and that said Letters Patent is hereby corrected as shown below:

Column 6,
Line 28, replace "Wherein" with -- wherein --;

Column 8,
Line 21, after "valve on the container;" insert -- and --;

Column 10,
Lines 31-32, replace "frustoconcial" with -- frustoconical --.

Signed and Sealed this

Third Day of December, 2002

JAMES E. ROGAN
*Director of the United States Patent and Trademark Office*